United States Patent [19]

Linn

[11] Patent Number: 4,568,809

[45] Date of Patent: Feb. 4, 1986

[54] METHOD FOR THE INDUCTION MELTING OF A CHARGE BLANK

[75] Inventor: Horst Linn, Hirschbach, Fed. Rep. of Germany

[73] Assignee: Linn Elektronik GmbH, Fed. Rep. of Germany

[21] Appl. No.: 644,993

[22] Filed: Aug. 28, 1984

Related U.S. Application Data

[63] Continuation-in-part of Ser. No. 506,331, Jun. 21, 1983, and Ser. No. 366,986, Apr. 9, 1982.

[51] Int. Cl.[4] ..... H05B 5/00; H05B 6/00

[52] U.S. Cl. ..... 219/10.41; 219/10.57; 219/6.5; 373/151; 373/156

[58] Field of Search ..... 219/10.41, 10.43, 10.51, 219/10.53, 10.57, 10.77, 10.79, 6.5, 7.5; 373/146, 156, 163, 138, 166, 151

[56] References Cited

U.S. PATENT DOCUMENTS 4,238,637 12/1980 Bengen et al. ..... 373/146

*Primary Examiner*—C. L. Albritton
*Assistant Examiner*—M. M. Lateef
*Attorney, Agent, or Firm*—Louis E. Marn

[57] ABSTRACT

There is disclosed an improved method of melting a charge blank of an electrically-conductive fusible material including the steps of positioning at least one substantially ring-shaped charge blank in a crucible wherein the charge blank has an outside transverse dimension and height of about 1.1 to 10 and 0.8 to 3, respectively, times an inside transverse dimension thereof, and thereafter subjecting the charge blank to the electromagnetic field of an induction coil.

13 Claims, 4 Drawing Figures

Fig. 1
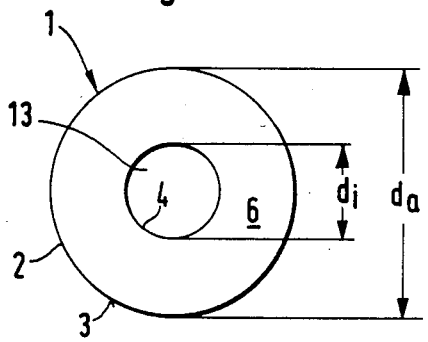
Fig. 3
PRIOR ART
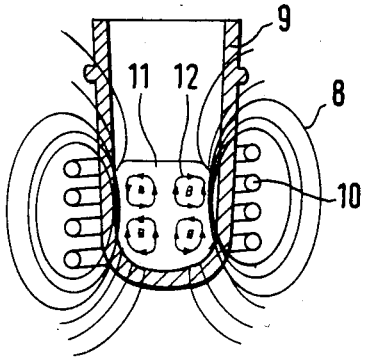
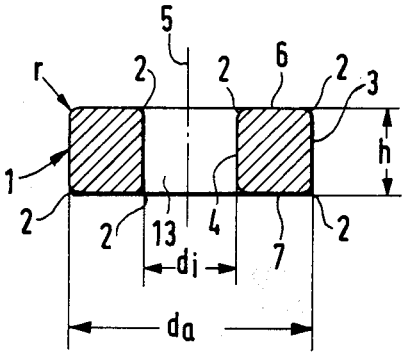
Fig. 2
Fig. 4
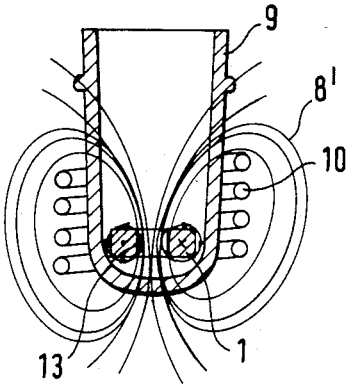

METHOD FOR THE INDUCTION MELTING OF A CHARGE BLANK

This is a continuation-in-part application of U.S. Application Ser. Nos. 506,331 and 366,986, filed June 21, 1983 and Apr. 9, 1982, respectively.

BACKGROUND OF THE INVENTION

The present invention relates to an improved method of melting charge blanks of electrically conductive, fusible material, and more particularly to an improved method of melting charge blanks by induction heating.

Induction casting equipment is frequently used, in particular for melting small amounts of metal, whether in the form of an alloy or in the form of a pure metal. Such equipment is used more particularly, for example, in connection with dentistry and dental technology, in the jewelry industry and in industrial fine or small-scale casting operations, and in fields of similar kinds. Hitherto, the material to be melted, whether an alloy or a pure metal, has been introduced into a melting pot or crucible in the form of granulated material of shots, bar portions, blocks or cut portions of various shapes and weights. Generally, the governing factor which determines the shapes and sizes of the pieces of material forming the charge to be melted is only the geometry of the crucible, that is to say, the size of the material introduced into the crucible is such that it can be easily disposed therein.

However, this mode of operation suffers from a number of disadvantages, more particularly, for example, pieces of charge material of different shapes and geometries form different induction circuits when subjected to the electromagnetic field of the induction coil used for heating the charge in the crucible and result in high heat radiation losses. Such variations in the induction circuits produced in the material to be melted result in different heating speeds and currents at the surface of the charge material. This phenomenon frequently results in inappropriate or defective processing of the material in the crucible. For example, the material may be overheated, i.e. higher melting temperatures, or may be heated for an excessively long period of time, i.e. higher than necessary energy requirements. Particulary when dealing with alloys, overheating or heating for an excessively long period may have the result that the properties of the material which are required or desired in the finished item and which are to be found in the alloy used as the starting material are detrimentally affected, thus reducing or even destroying the value of the item produced from the processed metal. In this respect, it should be noted that the times required for heating the metal in the crucible to provide for processing thereof may be relatively long in some situations, varying in dependence on the configuration of the pieces of charge material put into the crucible. In addition, the amount of gas which is absorbed and given off by the charge blanks to be melted may vary depending on the configuration of the blank used.

Another problem with previous processes of melting a blank in the above discussed manner is that it is often difficult to accurately determine the proper moment for the pouring or casting operation. If however that moment is not ascertained with a sufficient degree of accuracy, the material in the crucible may be overheated when it is poured or cast, or if the material in the crucible or pot has not yet reached the appropriate temperature, it is possible that particles of pure metal or alloy which have not yet been properly melted or fused in the crucible may be entrained with the flow of molten material as it is poured from the crucible. It will be appreciated that such unmolten or incompletely molten particles will detrimentally affect the quality of the item produced in the casting operation, for example, by forming defects, holes or shrinkage cavities, or porosity in the casting.

OBJECTS OF THE INVENTION

An object of the present invention is to provide an improved method for melting a charge blank comprised of an electrically-conductive fusible material in the electromagnetic field of an induction coil obviating the disadvantages of the previous processes as hereinabove discussed.

Another object of the present invention is to provide an improved method for melting a charge blank comprised of an electrically-conductive fusible material in the electromagnetic field of an induction coil resulting in the blank being rapidly melted with a comparatively small amount of energy input.

Still another object of the present invention is to provide an improved method for melting a charge blank comprised of an electrically-conductive fusible material in the electromagnetic field of an induction coil permitting easier and quicker degassing during the melting operation.

A further object of the present invention is to provide an improved method for melting a charge blank comprised of an electrically-conductive fusible material in the electromagnetic field of an induction coil permitting of facile determination of the proper moment for casting or pouring of the charge material.

Yet a further object of the present invention is to provide an improved method for melting a charge blank comprised of an electrically-conductive fusible material in the electromagnetic field of an induction coil in a melting pot or crucible which contributes to more accurate metering or quantitative control of the charge material in the pouring or casting operation.

A still further object of the present invention is to provide an improved method for heating a charge comprised of an electrically-conductive fusible material selected from the group consisting of gold, platinum, silver, gold alloys, platinum alloys, silver alloys, chromium alloys and cobalt alloys, performed more quickly and with more accurate control.

SUMMARY OF THE PRESENT INVENTION

These and other objects of the present invention are achieved by positioning in a crucible an annular or substantially ring-shaped charge blank of an electrically-conductive fusible material of less than about 500 grams for processing wherein the charge blank has an outside transverse dimension and height of about 1.1 to 10 and 0.8 to 3, respectively, times an inside transverse dimension of the blank and wherein the charge blank is thereafter subjected to an electromagnetic field of an induction coil.

Using a charge blank in the form of a ring with specified dimensions provides a number of processing advantages over forms of charge material hithertoforce used in such a process, for example, charge material in the form of cubes, pellets, bar portions, blocks or cut portions as more fully hereinafter discussed.

BRIEF DESCRIPTION OF THE DRAWING

Further features and objects of the invention will become apparent from the following detailed description when taken with the accompanying drawing, wherein:

FIG. 1 is a plan view of an embodiment of a charge blank according to the principles of the present invention;

FIG. 2 is a cross-sectional view of FIG. 1;

FIG. 3 is a sectional view of a crucible with an induction coil therearound and with heretofore used charge in the crucible to indicate the pattern of electromagnetic field induced therein by the induction heating coil; and FIG. 4 is a view similar to that of FIG. 3 but using a charge blank of the present invention.

DETAILED DESCRIPTION OF THE INVENTION

An induction heating process is a kind of heat transfer operation wherein the density of power which can be transferred depends on the surface area of the member or portion to be heated. Now, considering for example a circular ring of substantially square or rectangular cross-section having a bore wherein the outside diameter of the ring configuration corresponds approximately to two-and-one-half times the inside diameter of the ring, i.e. the diameter of the bore and the height of the ring approximately correspond to the diameter of the bore, it can be easily calculated that the surface area of that ring is about one-and-one-half times the surface area of a cube of the same mass. This means that when a ring is used as the charge blank for an induction melting process, the amount of power required to cause the blank to melt is less than when using a blank of different non-ring configuration, because of the larger surface area of the ring blank. However, the larger surface area of the ring also has the advantage that any gases which may be contained in the charge blank can escape more quickly than if the surface area of the charge blank were smaller, and that is a particularly important consideration in vacuum casting, as the elimination of gas in that manner permits the quality of the casting produced to be improved.

With regard to the speed at which the charge material in the crucible or pot is caused to melt, the depth of penetration of the electromagnetic waves, in dependence on frequency, also plays a part, as it is only if there is a sufficient depth of penetration of the electromagnetic waves into the charge blank that a corresponding amount of power can be transmitted to the blank. The depth of wave penetration is calculated in accordance with the following formula:

$$\delta = \frac{1}{\sqrt{\pi \cdot f \cdot \mu_o \cdot \mu_r \cdot \frac{1}{\rho}}} \quad (1)$$

in which:

$\delta$=depth of penetration

F=operating frequency $\mu_o$=permeability=$1.256\times10^{-6}$ Vs/Am $\mu_r$=relative permeability $\rho$=specific resistance (V/A)

The full depth of penetration may be utilized in particular when the ring is operating as a short circuit ring, although it will be appreciated that certain conditions must then be fulfilled for that purpose, as will be described in greater detail hereinafter.

Besides the advantage achieved by virtue of the larger surface area of the ring, using a ring configuration as a charge blank for an induction melting operation also provides further advantages, namely, the high frequency used for operating the induction coil may be coupled to the ring blank in a highly satisfactory and efficient manner, excellent temperature distribution can be achieved even when a plurality of rings are disposed one above the other in the crucible thereby to achieve uniform heating of the blanks, and good metering or quantitative determination can be readily achieved. In addition, using a ring as the charge blank means that the melting point of the charge blank can generally be detected or ascertained with a very high degree of accuracy, as it is easily possible to see when the specific ring configuration of the charge begins to dissolve so that the possibility of defects in the article produced, as a result of pouring or casting the molten material at an excessively high or excessively low temperature, can be considerably reduced.

In principle, the ring may be of very widely varying shapes and dimensions. Tests have shown however that particularly good results can be achieved when the outside diameter of the ring is from 1.1 to 10 times the inside diameter thereof, and the height of the ring is from 0.8 to 3 times the inside diameter of the ring. In a preferred embodiment, the outside diameter is approximately 2.5 times the inside diameter, while the height of the ring is approximately equal to the inside diameter thereof.

When, in accordance with the invention, the charge blank is in the form of such a ring, it is usually desirable to perform the process in such a manner that the ring operates in a short circuit mode or as a short circuit ring, which can result in particularly rapid heating. It should be observed in this case however that the size of the inside diameter of the ring, that is to say, the diameter of the bore in the ring, is such that the limit frequency which occurs in operation is taken into account. In other words, such that the electromagnetic field can still pass through the bore in the ring. In this respect, the term limit frequency means the frequency which sets the limit between the attenuation and wave performance of a wave guide. That frequency is calculated by the following formula:

$$f_c = \frac{C_o}{2\pi\sqrt{E_r \cdot \mu_r}} \cdot q_v \frac{1}{\text{sec.}} \quad (2)$$

in which:

$f_c$=limit frequency $q_v$=characteristic value of the wave 1/m $\epsilon_r$=dielectric constant $\mu_r$=relative permeability $C_o$=speed of light In the case of a ring, the limit frequency is calculated in the following manner:

$$f_c = \frac{C_o \cdot 1.841}{\pi \cdot d_i} \quad (3)$$

in which $d_i$ is the diameter of the bore in the ring.

It will be seen therefore that, with an inside diameter of 8 mm., the limit frequency is about 22 GHz, so that the inside diameter of the ring should desirably be less than 8 mm.

Another feature of the invention provides that the blank is of approximately square or rectangular cross-section, with rounded edges or corners to its section. The individual surfaces of the ring extend substantially parallel or substantially normal to the axis of the ring, such a configuration providing a particularly large surface area. In addition, it is readily possible for a plurality of such ring configurations to be stacked one upon the other, in which case the surfaces which are normal to the axis of the ring each lie one upon the other. The rounded edges or corners are required in particular to prevent overheating. In this connection, it is desirable for the radius of the rounded edges or corners to be at least 1/10th of the inside diameter of the ring.

In a preferred embodiment, the blank in accordance with the present invention is in the form of a circular ring. As such, a ring can generally be used in a particularly advantageous and favorable manner.

Bearing in mind the above discussed factors, the blank may be of widely varying dimensions. For example, the outside diameter of the ring may be from about 10 to 50 mm., the inside diameter may be from about 3 to 30 mm. and the height of the ring may also be from about 3 to 30 mm.

Referring to FIG. 1, there is shown a charge blank 1, for use in a method for melting a fusion charge by induction heating thereof, substantially in the form of a ring or annular member of electrically-conductive, fusible material, whether in pure or alloyed form in an amount of less than 500 grams, preferably between about 20 to 100 grams. The charge blank 1 is illustrated in the form of a circular ring, with the dimensions such that the inside diameter ($d_i$) is about 8 mm., the outside diameter ($d_a$) is about 20 mm. and the height (h) (FIG. 2) is about 7 mm. It will be seen from this that the height (h) and the inside diameter ($d_i$) are approximately the same, while the outside diameter ($d_a$) is about 2.5 times the inside diameter ($d_i$) of the charge blank 1. The charge blank 1 is formed of an electrically-conductive fusible material, and for certain application as electrically-conductive fusible material selected from the group consisting of gold, platinum, silver, gold alloy, platinum alloy, silver alloy, chromium alloy and a cobalt alloy, and can be heated and fused in the electromagnetic field of an induction coil.

Reference to FIG. 2 will clearly show that the charge blank 1 is substantially square in cross-section, with the edge of corner regions, indicated at 2, being rounded off with a radius (r). The radius (r) is desirably at least one-tenth of the inside diameter ($d_i$). The fact that the charge blank 1 is of a rectangular configuration or a square configuration as illustrated means that the surfaces thereof are so disposed that an outside peripheral surface 3 and an inside peripheral surface 4 of the charge blank 1 each extend at least substantially parallel to an axis 5 of the charge blank 1, while axially facing surfaces 6 and 7 of the charge blank 1, are substantially normal to the axis 5. With this configuration therefore, if a larger amount of material than would be provided by one such charge blank is required to be melted in the induction heating operation, a plurality of rings may be stacked one upon the other in the melting crucible with, for example, the height of such rings possibly varying from one charge blank to another in order to provide the appropriate amount of molten material. When stacked in such way, the charge blanks lie flat upon each other in close contact with each other at surfaces 6 and 7, so that the electromagnetic field is not subjected to an excessive amount of impediment or distortion between adjacent rings. The rounded configuration of the corner portions 2 of radius (r) also prevents overheating from occurring in those areas, which might otherwise be the case if the corner portions were sharp-edged.

It will be appreciated that the dimensions of the charge blank 1 may be varied from those indicated above in regard to the illustrated ring, although the following limits should advantageously be observed:

$$1.1d_i \leqq d_a \leqq 10d_i$$

$$0.8d_i \leqq h \leqq 3d_i$$

Reference will now be made to FIGS. 3 and 4 in order to more clearly demonstrate the effect of the annular charge blank in accordance with the present invention.

Referring first to FIG. 3, there is shown a crucible 9 having an induction heating coil 10 disposed therearound to produce an electromagnetic field 8. By virtue of the charge blank 11 disposed in the crucible 9, namely of a generally cube-like configuration, the electromagnetic field 8 only penetrates into the outer surface regions of the charge blank 11. Eddy currents are then produced in the charge blank, as indicated at 12. In spite of this however, because of the comparatively small depth of penetration of the electromagnetic field 8 into the charge blank, the amount of energy transferred by the field 8 of the induction coil 10 to the blank 11 is only comparatively small.

Referring now to FIG. 4, there is shown a charge blank 1 substantially in the form of a ring, the field lines 8' of the electromagnetic field produced by the induction coil 10 pass through the bore 13 in the charge blank 1 which is used as a short circuit ring. This provides for a comparatively large amount of energy to be applied to the charge blank 1 so that the charge blank can be quickly heated up. In addition, the ring configuration permits full use to be made of the available depth of electromagnetic wave penetration so that energy is transferred to the charge blank from the electromagnetic field not merely at the surface of the charge blank but also at comparatively great depth within the charge blank. It will be seen, therefore, that the substantially ring-shaped configuration of the charge blank 1 provides for better coupling as between the charge blank 1 and the electromagnetic field, as well as a higher degree of accuracy and precision and an improved level of quality in the casting produced from the molten charge formed from the charge blank.

Advantages of the method of the present invention are described in the following specific examples which are intended to be merely illustrative of the present invention, and the present invention is not intended to be limited thereto.

EXAMPLES

Charge blanks of an electrically-conductive, fusible material comprised of 1% Si; 2% Mn; 18% Cr; 10% Ni; remainder iron were formed into the following dimensional shapes (in mm.):

(A) Ring: $d_a=20$; $d_i=8$; $h=8$;

(B) Ring: $d_a=20$; $d_i=16$; $h=8$;

(C) Hollow Cylinder: $d_a=20$; $d_i=8$; $h=28$; and (D) Solid Rectangle: 15×15×32.9.

Equal amounts (58.5 gms.) of the shapes were positioned in a crucible (i.e. four (4) A rings; twenty (20) B rings; one (1) hollow cylinder; and one (1) solid rectangle). Ten (10) melting tests for each amount resulted in the following average energy requirements to effect melting:

(A) 2.04 KW·sec./gm.
(B) 1.77 KW·sec./gm.
(C) 2.28 KW·sec./gm.
(D) 2.32 KW·sec./gm.

Clearly, the test of the A-rings demonstrate lower energy requirements than the tests of the C-hollow cylinder and D-solid rectangle. While the B-rings resulted in lower energy requirement than the A-rings, difficulties were experienced in piling the B-rings in the crucible; there was contamination in the molten material; extreme temperature variations were experienced throughout the pile with adherence of some rings to the sides of the crucible; and losses of volatile alloy components which in totality demonstrated the inefficacy of the use of the B-rings in induction heating.

In summary, the method of the present invention results in reduced energy requirements for melting; effective piling; reduced danger of contamination; rapid melting and the like.

It will be appreciated that the present invention has been described by way of example and that various modifications and alterations may be made therein without thereby departing from the scope and spirit of the present invention. For example, the charge blank illustrated is in the form of a circular ring, but deviations from circularity of the ring may be envisaged, while however still remaining of a generally ring-like configuration; it will be appreciated that, in such a situation, it is no longer strictly appropriate to refer to inside and outside diameters of the ring. In view of the above mentioned departure from circularity, so that in relation to such a general configuration, the references to diameters are to be construed as references to appropriate transverse dimensions.

What is claimed:

1. An improved method of melting a charge blank of an electrically-conductive fusible material, comprising the steps of:

positioning in a crucible at least one substantially ring-shaped charge blank having a bore and of a weight of less than 500 grams, said charge blank having an outside dimension of about 1.1 to 10 times a dimension of said bore and a height of about 0.8 to 3 times said dimension of said bore; and subjecting said substantially ring-shaped charge blank to an electromagnetic field of an induction heating coil.

2. The improved method of melting a charge blank as defined in claim 1 wherein a plurality of said charge blanks are disposed in said crucible.

3. The improved method of melting a charge blank as defined in claim 1 wherein said outside dimension and said height are 2.5 and 1.0, respectively, times said dimension of said bore.

4. The improved method of melting a charge blank as defined in claim 1 wherein said dimension of said bore is not more than 8 mm.

5. The improved method of melting a charge blank as defined in claim 1 wherein said outside dimension is between about 10 and 24 mm., said dimension of said bore is between about 5 and 15 mm., and said height is between about 5 and 12 mm.

6. The improved method of melting a charge blank as defined in claim 1 wherein said substantially ring-shaped charge blank is of substantially rectangular cross-section with rounded corners; and wherein inside and outside peripheral surfaces of said ring-shaped charge blanks extend at least substantially parallel to an axis of rotation thereof and axially facing surfaces of said ring-shaped charge blanks are at least substantially normal to said axis of rotation.

7. The improved method of melting a charge blank as defined in claim 6 wherein said ring-shaped charge blank is substantially square in cross section.

8. The improved method of melting a charge blank as defined in claim 6 wherein a radius of said rounded corners or said ring-shaped charge blank is at least one-tenth of said dimension of said bore.

9. The improved method of melting a charge blank as defined in claim 1 wherein said ring-shaped charge blank is substantially circular in cross-section.

10. The improved method of melting a charge blank as defined in claim 1 wherein said electrically-conductive fusible material is selected from the group consisting of gold, platinum, silver, gold alloy, platinum alloy, silver alloy, chromium alloy and a cobalt alloy.

11. The improved method of melting a charge blank as defined in claim 10 wherein said chromium alloy also contains nickel.

12. The improved method of melting a charge blank as defined in claim 10 wherein said cobalt alloy also contains titanium.

13. The improved method of melting a charge blank as defined in claim 10 wherein said chromium alloy also contains titanium.

* * * * *